US007997924B2

(12) United States Patent
Yu

(10) Patent No.: US 7,997,924 B2
(45) Date of Patent: Aug. 16, 2011

(54) CONNECTOR FOR FLEXIBLE PRINTED CIRCUIT BOARD

(75) Inventor: Sheng-Nan Yu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 199 days.

(21) Appl. No.: 12/510,018

(22) Filed: Jul. 27, 2009

(65) Prior Publication Data

US 2011/0021065 A1 Jan. 27, 2011

(51) Int. Cl.
*H01R 12/24* (2006.01)

(52) U.S. Cl. ..... 439/495

(58) Field of Classification Search ..... 439/495, 439/260, 497

See application file for complete search history.

(56) References Cited

U.S. PATENT DOCUMENTS 4,944,690 A * 7/1990 Imai ..... 439/492
7,775,827 B2 * 8/2010 Huang et al. ..... 439/495

* cited by examiner

*Primary Examiner* — Edwin A. Leon
*Assistant Examiner* — Vanessa Girardi
(74) *Attorney, Agent, or Firm* — Cheng-Ju Chiang

(57) ABSTRACT

A connector includes an insulating housing having a flat base board, a plurality of electric terminals disposed in the insulating housing for electrically contacting the flexible printed circuit board and a shell pivotally and slidably mounted to the insulating housing. The shell has a base plate. A transverse rear edge of the base plate extends downward to form a preventing board perpendicular to the base plate. A bottom portion of an edge of the preventing board is bent frontward to form a hook portion facing the base plate. The shell is turned towards the base board to be covered onto the insulating housing to make the flexible printed circuit board located between the insulating housing and the shell. Then the shell is pushed frontward to make the locking portion hooked to the base board so as to generate a downward pull force to the base plate of the shell.

10 Claims, 5 Drawing Sheets

CONNECTOR FOR FLEXIBLE PRINTED CIRCUIT BOARD

BACKGROUND OF THE INVENTION

1. Field of the Invention

The present invention generally relates to an electrical connector, and more particularly to a connector for a flexible printed circuit (FPC hereinafter for simplification) board.

2. The Related Art

Generally, an FPC connector is adapted for receiving an FPC board therein. The FPC connector includes an insulating housing, a plurality of electric terminals disposed in the insulating housing and electrically contacting the FPC board, and a shell pivoted to the insulating housing and capable of holding the FPC board for making the electric terminals and the FPC board connected with each other firmly.

However, the shell needs to be lengthened to comply with the increase of the amount of the electric terminals. As a result, the shell may deform due to an upward pressure from the electric terminals and the FPC board. Moreover, this may cause the electric terminals located in a middle of the insulating housing not contacting the FPC board, so the electrical connection between the FPC board and the electrical terminals is not steady.

SUMMARY OF THE INVENTION

An object of the present invention is to provide a connector adapted for receiving a flexible printed circuit board therein. The connector includes an insulating housing having a flat base board, a plurality of electric terminals disposed in the insulating housing for electrically contacting the flexible printed circuit board and a shell pivotally and slidably mounted to the insulating housing. The shell has a base plate. A transverse rear edge of the base plate extends downward to form a preventing board. A bottom portion of an edge of the preventing board far away from the base plate is extended and bent frontward to form a hook portion facing the base plate. The shell is turned frontward and towards the base board to be covered onto the insulating housing to make the flexible printed circuit board located between the insulating housing and the shell. Then the shell is frontward pushed to make the locking portion hooked to the base board so as to generate a downward pull force to the base plate of the shell.

As described above, the connector of the prevent invention utilizes the hook portion of the shell to be hooked to the base board of the insulating housing so as to generate the downward pull force to the base plate of the shell. Therefore, a steadily electrical connection can be achieved between the flexible printed circuit board and the electric terminals.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
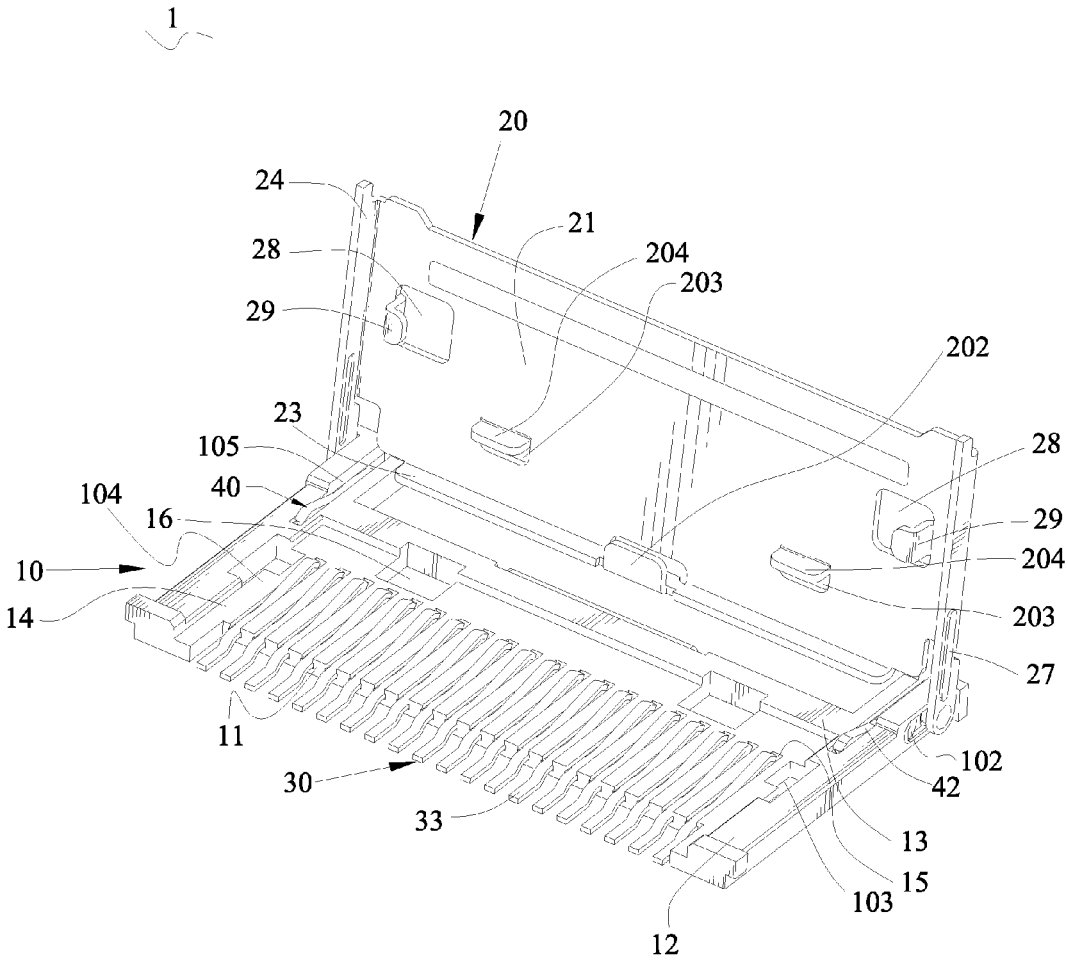
FIG. 1 is a perspective view of an FPC connector in accordance with the present invention.
Figure 2:
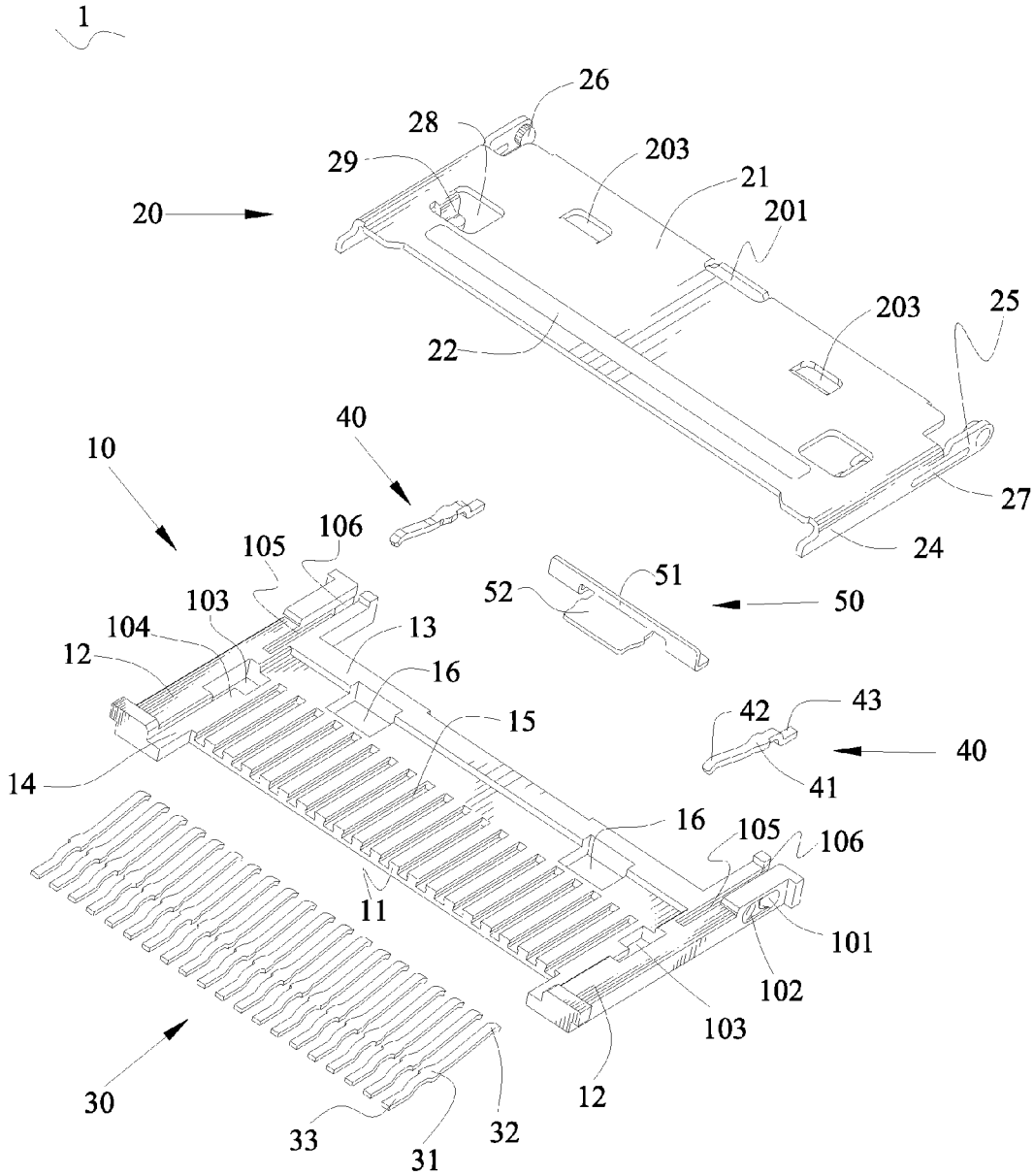
FIG. 2 is an exploded view of the FPC connector of FIG. 1.

Referring to FIG. 1 and FIG. 2, an FPC connector 1 in accordance with the present invention includes an insulating housing 10, a shell 20 pivotally and slidably mounted to the insulating housing 10, a plurality of electric terminals 30, a pair of ground terminals 40 and a fastening member 50 disposed in the insulating housing 10 respectively.

Figure 4:
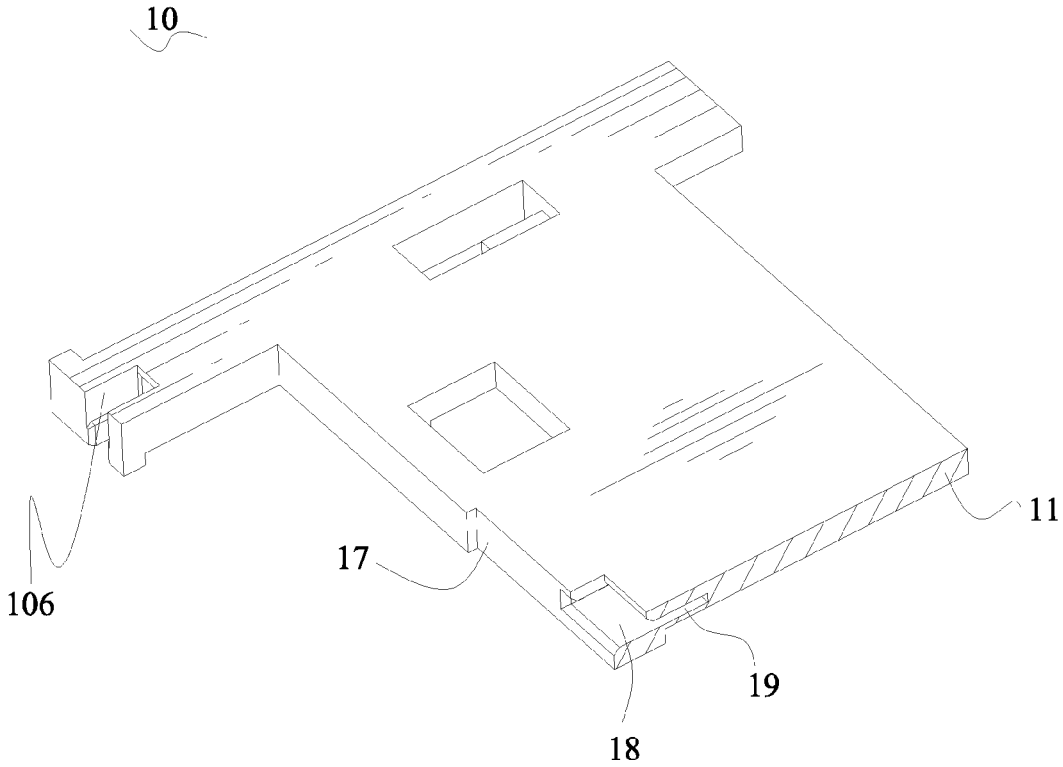
FIG. 4 is a cutaway perspective view of an insulating housing of the FPC connector of FIG. 1.
Figure 5:
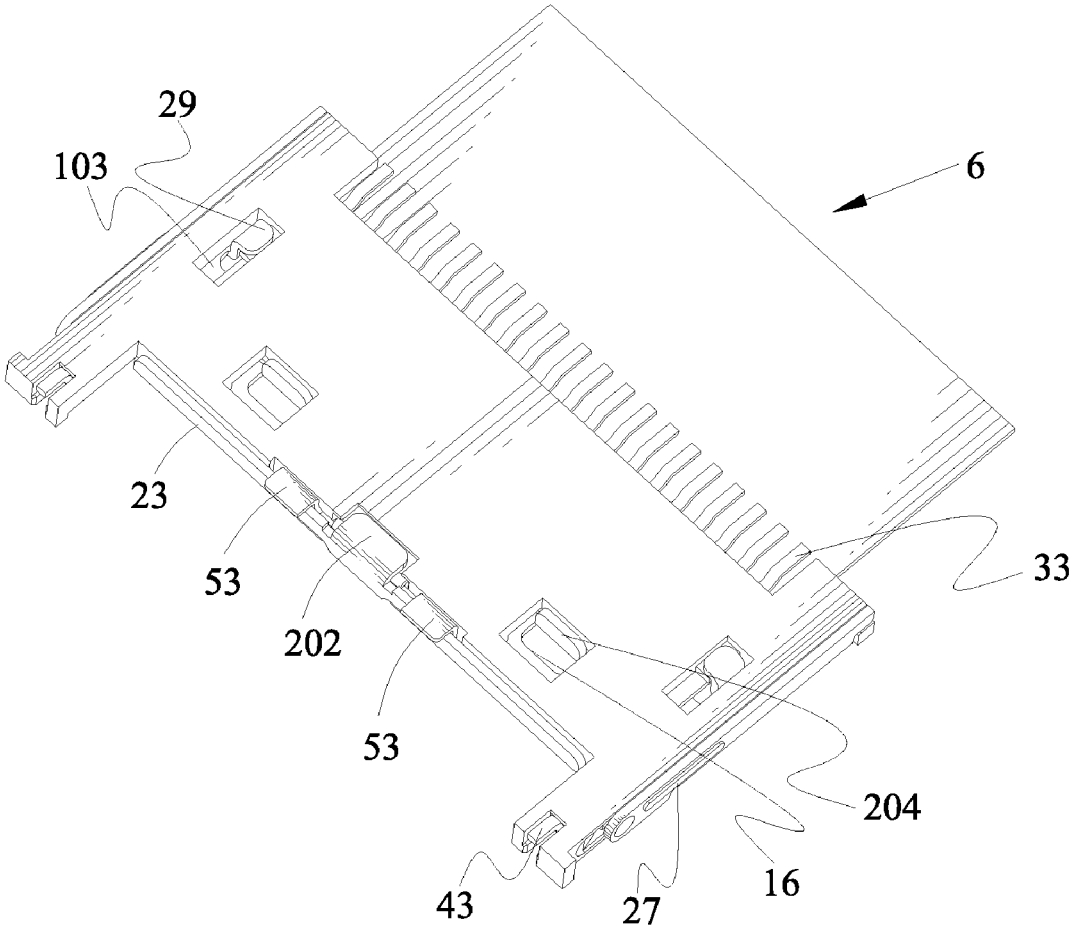
FIG. 5 is a perspective view of the FPC connector of FIG. 1, in which an FPC board is inserted.
Figure 6:
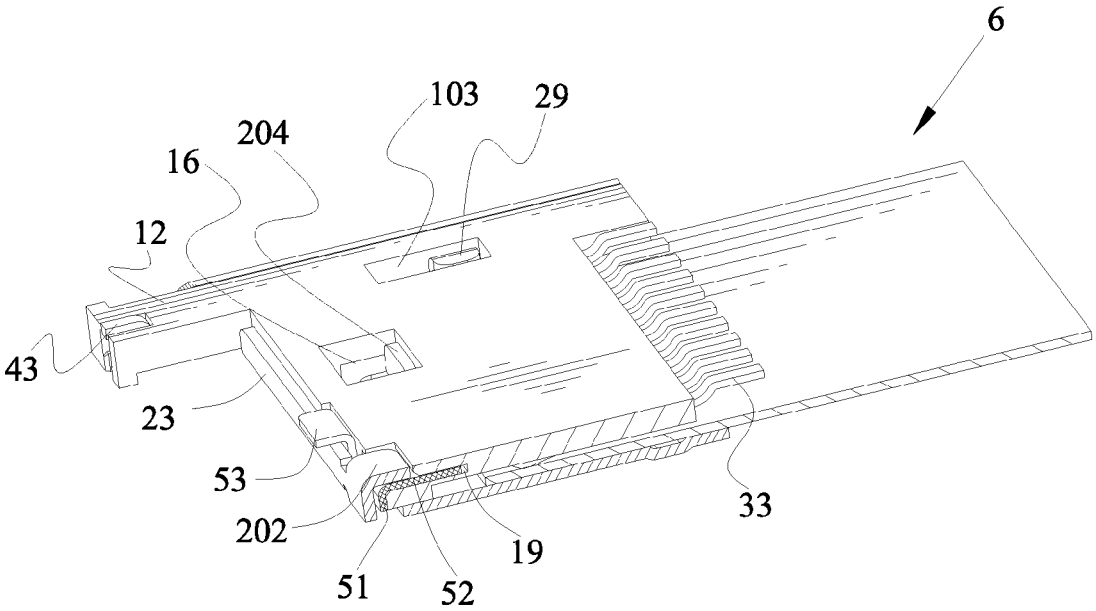
FIG. 6 is a cutaway perspective view of the FPC connector with the FPC board therein of FIG. 5.

Referring to FIG. 1, FIG. 2 and FIG. 4, the insulating housing 10 has a rectangular flat base board 11. Two opposite ends of the base board 11 protrude upward to form a pair of sidewalls 12 each extending longitudinally beyond a rear edge of the base board 11. A rear end of the base board 11 protrudes upward to form a preventing wall 13 extending transversely to be perpendicularly connected with the two sidewalls 12. A receiving recess 14 is defined among the two sidewalls 12 and the preventing wall 13 to receive an FPC board 6 therein shown in FIG. 5 and FIG. 6. A front of the base board 11 defines a plurality of terminal passageways 15 arranged at regular intervals along a transverse direction thereof and each extending longitudinally to communicate with the receiving recess 14. A junction of the base board 11 and the preventing wall 13 defines a pair of inserting holes 16 spaced away from each other and each vertically penetrating therethrough to communicate with the receiving recess 14. A middle of a rear surface of the preventing wall 13 defines a holding groove 17 extending transversely and vertically penetrating therethrough. A middle of a bottom of the holding groove 17 further extends forward to form a fastening cavity 18, and a top of the fastening cavity 18 further extends forward into the base board 11 to form a fastening slot 19. A rear end of an outside of each of the sidewalls 12 defines a first positioning groove 101 and a second positioning groove 102 in front of the first positioning groove 101. A substantial middle of a junction of each of the sidewalls 12 and the base board 11 defines a rectangular locating hole 103 vertically passing therethrough to communicate with the receiving recess 14. A top of a front of an inner edge of the locating hole 103 far away from the corresponding sidewall 12 extends towards the respective sidewall 12 to form a buckling portion 104 spaced away from the corresponding sidewall 12. A rear of a top surface of the sidewall 12 defines a fixing fillister 105 extending longitudinally to pass through a rear edge of the sidewall 12. A rear end of the fixing fillister 105 further extends downward to penetrate through the corresponding sidewall 12 to form a receiving fillister 106.

Referring to FIG. 1 and FIG. 2 again, the shell 20 has a rectangular flat base plate 21. A middle of a front of the base plate 21 protrudes upward to form a first holding rib 22 extending transversely. A rear edge of the base plate 21 extends downward to form a preventing board 23. Two opposite end edges of the base plate 21 extend downward to form a pair of sideboards 24 each having a free rear end disconnected with the base plate 21 and defined as an elastic arm 25. Rear ends of the two elastic arms 25 face-to-face protrude to form a pair of positioning lumps 26. A second holding rib 27 extending longitudinally is provided across a junction of the sideboard 24 and the elastic arm 25 and protruded towards an opposite direction to the corresponding positioning lump 26 for preventing the elastic arm 25 from being broken. A front of each of two sides of the base plate 21 defines a first window 28 adjacent to the corresponding sideboard 24. Two outer edges of the two first windows 28 respectively adjacent to the corresponding sideboards 24 extend downward and then are face-to-face bent to form a pair of locking portions 29. A middle of the rear edge of the base plate 21 defines a second window 201 with a middle of the preventing board 23 acted as a rear rail of the second window 201. A middle of a bottom edge of the preventing board 23 is extended and bent forward to form a hook portion 202 located under the second window 201. A rear of the base plate 21 defines a pair of third windows 203 transversely aligned with and spaced away from each other to be respectively located between the second window 201 and one corresponding first window 28. Two front edges of the two third windows 203 extend downward to form a pair of preventing portions 204.

With reference to FIG. 2 again, each of the electric terminals 30 has a first base portion 31 extending longitudinally. One end of the first base portion 31 extends rearward and inclines upward, and then is bent downward to form a first contact portion 32. The other end of the first base portion 31 is bent downward and then extends forward to form a first soldering portion 33. Each of the ground terminals 40 is similar to the electric terminals 30 and has a second base portion 41 extending longitudinally, a second contact portion 42 which extends forward and inclines upward, and then is bent downward from one end of the second base portion 41, and a second soldering portion 43 which is bent downward and then extends rearward from the other end of the second base portion 41.

Figure 3:
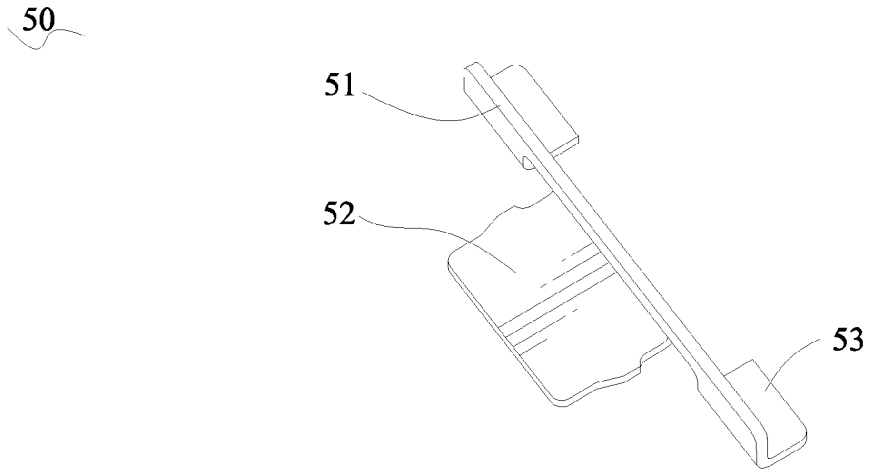
FIG. 3 is a perspective view of a fastening member of the FPC connector of FIG. 1.

Referring to FIG. 2 and FIG. 3, the fastening member 50 has a connecting arm 51 with a strip shape. A middle of an edge of the connecting arm 51 extends towards a perpendicular direction thereof to form a tongue 52. Two opposite ends of the edge of the connecting arm 51 are bent towards an opposite direction to the tongue 52 to form a pair of soldering tails 53 spaced away from each other.

Referring to FIGS. 1-6, in assembly, the electric terminals 30 are inserted rearward with the first base portions 31 received in the corresponding terminal passageways 15 and the first contact potions 32 stretching into the receiving recess 14, and the first soldering portions 33 exposed out of a front edge of the base board 11 for being soldered with a printed circuit board (not shown). The ground terminals 40 are inserted forward with the second base portions 41 fixed in the corresponding fixing fillisters 105 and the second contact portions 42 exposed upward out of the corresponding fixing fillisters 105 and the second soldering portions 43 are received in the corresponding receiving fillisters 106 for being soldered with the printed circuit board. The fastening member 50 is inserted forward with the connecting arm 51 held in the holding groove 17, the tongue 52 received in the fastening cavity 18 and a free end of the tongue 52 inserted into the fastening slot 19. The soldering tails 53 are exposed out of the rear edge of the base board 11 for being soldered with the printed circuit board. The positioning lumps 26 of the shell 20 are pivoted in the corresponding first positioning grooves 101 so as to make the shell 20 pivoted to the insulating housing 10.

In use, when the FPC board 6 is to be inserted into the FPC connector 1, the FPC board 6 is clipped between the two locking portions 29 and held by the preventing portions 204. Then the shell 20 is turned forward to be covered onto the insulating housing 10 to make the preventing portions 204 partially received into the corresponding inserting holes 16 and the locking portions 29 partially located in the corresponding locating holes 103. The FPC board 6 is received in the receiving recess 14 of the insulating housing 10. The first contact portions 32 of the electric terminals 30 electrically contact the FPC board 6 and the second contact portions 42 of the ground terminals 40 electrically abut against the base plate 21 of the shell 20, so the electromagnetic interference signals generated between the electric terminals 30 and the FPC board 6 can be completely dispersed out by means of the shell 20 and the ground terminals 40. Then the shell 20 is further pushed forward till the positioning lumps 26 are slid into the corresponding second positioning grooves 102 from the first positioning grooves 101. At this time, the locking portions 29 are buckled with the corresponding buckling portions 104 to prevent the shell 20 from overturning upward, the preventing portions 204 are against a front wall of the corresponding inserting holes 16, the preventing board 23 abuts against the rear surface of the preventing wall 13 to further hold the connecting arm 51 in the holding groove 17, and the hook portion 202 is hooked into the fastening cavity 18 and against a bottom surface of the tongue 52 so that generates a downward pull force to the base plate 21 of the shell 20 and further ensures a steadily electrical connection between the FPC board 6 and the electric terminals 30. The first holding rib 22 is located above the electric terminals 30 for preventing the shell 20 from being upswept because of an upward force from the electric terminals 30.

As described above, the FPC connector 1 of the prevent invention utilizes the hook portion 202 of the shell 20 to be hooked against the bottom surface of the tongue 52 of the fastening member 50 fastened in the rear of the insulating housing 10 so as to generate the downward pull force to the base plate 21 of the shell 20 for preventing the shell 20 from being upswept. Therefore, a steadily electrical connection can be achieved between the FPC board 6 and the electric terminals 30.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector adapted for receiving a flexible printed circuit board therein, comprising:

an insulating housing having a flat base board;

a plurality of electric terminals disposed in the base board of the insulating housing for electrically contacting the flexible printed circuit board; and a shell pivotally and slidably mounted to the insulating housing and having a base plate, a transverse rear edge of the base plate extending downward to form a preventing board, a bottom portion of an edge of the preventing board away from the base plate being extended and bent frontwardly to form a hook portion facing the base plate, the shell being turned frontward and towards the base board to be covered onto the insulating housing to make the flexible printed circuit board located between the insulating housing and the shell, then the shell being frontward pushed such that a locking portion thereof is hooked to the base board so as to generate a downward pull force to the base plate of the shell.

2. The connector as claimed in claim 1, wherein a portion of the rear edge of the base plate defines a window adjacent to the preventing board, the hook portion is located to face the window.

3. The connector as claimed in claim 1, wherein the base plate protrudes towards an opposite direction to the preventing board to form at least one holding rib extending transversely.

4. The connector as claimed in claim 1, wherein two opposite ends of the base board extend upward to form a pair of sidewalls, a rear end of an outside of the sidewall defines two positioning grooves spaced away from and longitudinally aligned with each other, two opposite end edges of the base plate of the shell extend downward to form a pair of sideboards, rear ends of the sideboards face-to-face protrude to form a pair of positioning lumps each slid into the former positioning groove from the latter positioning groove pivoted with the corresponding positioning lump.

5. The connector as claimed in claim 1, further comprising at least one ground terminal having a base portion fastened in the insulating housing, a contact portion and a soldering portion oppositely extending from two opposite ends of the base portion, the contact portion being exposed upward out of the insulating housing for being electrically against the base plate of the shell and the soldering portion stretching out of the insulating housing.

6. The connector as claimed in claim 1, further comprising a fastening member having a connecting arm, a substantial middle of an edge of the connecting arm extending towards a perpendicular direction thereof to form a tongue, two opposite ends of the edge of the connecting arm being bent towards an opposite direction to the tongue to form a pair of soldering tails, wherein the connecting arm is held in a rear surface of the base board, the tongue is against a bottom of the base board and the soldering tails are exposed out of the base board, the preventing board of the shell is against the rear surface of the base board to further hold the connecting arm and the hook portion hooked to a bottom of the tongue.

7. The connector as claimed in claim 6, wherein the rear surface of the base board defines a holding groove extending transversely and vertically penetrating therethrough, a substantial middle of a bottom of the holding groove extends forward to form a fastening cavity, a top of the fastening cavity further extends forward into the base board to form a fastening slot, the connecting arm of the fastening member is held in the holding groove, the tongue is received in the fastening cavity, a free end of the tongue is inserted into the fastening slot.

8. The connector as claimed in claim 1, wherein two opposite ends of the base board respectively define a locating hole passing therethrough, two ends of the base plate of the shell define a window respectively, two outer edges of the two windows extend downward and then are face-to-face bent to form a pair of locking portions for clipping the flexible printed circuit board therebetween, when the shell is closed, the locking portions are located in the corresponding locating holes.

9. The connector as claimed in claim 8, wherein a front of an inner edge of the locating hole extends towards a facing outer edge thereof to form a buckling portion, the locking portion is buckled with the corresponding buckling portion from the corresponding locating hole.

10. The connector as claimed in claim 8, wherein a rear of the base plate protrudes downward to form a pair of preventing portions transversely aligned with and spaced away from each other to be respectively located between the preventing board and the corresponding locking portions for blocking the flexible printed circuit board.

* * * * *